United States Patent [19]

Angliss

[11] 4,208,891

[45] Jun. 24, 1980

[54] APPLICATION OF LIQUID TO YARNS

[75] Inventor: Ian B. Angliss, Belmont, Australia

[73] Assignee: Commonwealth Scientific and Industrial Research, Campbell, Australia

[21] Appl. No.: 961,070

[22] Filed: Nov. 15, 1978

[30] Foreign Application Priority Data

Nov. 25, 1977 [AU] Australia ..... 2565/77

[51] Int. Cl.[2] ..... D06B 3/06; D06B 15/08

[52] U.S. Cl. ..... 68/19; 15/256.6; 118/124; 118/420; 134/64 R

[58] Field of Search ..... 8/151.2; 68/19, 19.1, 68/175; 427/356, 358; 118/124, 420, DIG. 18, DIG. 19; 134/9, 15, 64 R, 64 P, 122 R, 122 P; 15/256.6

[56] References Cited

U.S. PATENT DOCUMENTS

| | | | |
|---|---|---|---|
| 1,575,822 | 3/1926 | Davis | 118/124 |
| 1,843,078 | 1/1932 | Berger | 118/420 X |
| 2,558,734 | 7/1951 | Cresswell | 68/19 X |
| 3,045,315 | 7/1962 | Dusenbury | 68/175 X |

FOREIGN PATENT DOCUMENTS

| | | | |
|---|---|---|---|
| 2158932 | 5/1973 | Fed. Rep. of Germany | 68/19 |

*Primary Examiner*—Philip R. Coe

*Attorney, Agent, or Firm*—Sughrue, Rothwell, Mion, Zinn and Macpeak

[57] ABSTRACT

Method and apparatus for applying liquid to a yarn in which the direction of travel of the wetted yarn is changed to an extent effective to cause excess liquid to be ejected into a space adjacent the yarn by failing to wholly make said change in direction of travel with the yarn. A preferred apparatus includes a pair of slotted plates. A slot in one plate effects the required change in direction of travel while the other plate provides a collecting surface for the ejected liquid.

2 Claims, 3 Drawing Figures

APPLICATION OF LIQUID TO YARNS

This invention relates to the application of liquids to travelling yarns.

In the application of liquids, such as dyes, to yarns it is usual to treat the yarn as a moving filament, rather than in package form, in order to facilitate uniform distribution of the liquid. A number of devices have been described for the application of liquids to continuously moving yarn but each gives rise to problems when operated at high speed i.e. when yarn velocities exceed about 100 meters/minute, which is a normal winding speed for textile yarns.

In one prior method the yarn is run through a liquid bath and excess liquid is removed by squeezing the yarn between nip rollers. The method operates quite satisfactorily at low speeds but as the yarn velocity is increased removal of liquid from the rollers becomes unmanageable and uncontrolled non-uniform distribution of liquid on the yarn occurs.

Another prior method involves bringing the moving yarn into contact with a roller which dips into a bath of liquid, the object being to transfer liquid from the roller to the yarn. At high speeds the liquid picked up by the roller from the bath is thrown randomly from the roller by centrifugal force, and the yarn is not uniformly wetted by the liquid.

A further prior method is to impregnate the yarn using compressed air cells, and then pass it through an expression cell where it meets a counter-current of compressed air. The shock wave so produced removes excess liquid and at the same time improves liquid penetration into the yarn, but the method does not achieve better than a retention of 60 parts of liquid by weight to every 100 parts by weight of yarn, i.e. a 60% pick-up, which in dyeing processes is not sufficient for even distribution of liquor during subsequent steaming or heat treatments.

A still further prior proposal, exemplified by U.S. Pat. Nos. 2,513,432 and 3,889,634, has been to momentarily contact the dry yarn approaching the bath and the wetted yarn leaving the bath, whereby the dry yarn absorbs excess liquid from the wetted yarn.

The object of the present invention is to avoid the aforedescribed disadvantages of prior apparatus and methods, while providing a technique for the application of liquids to yarn in a manner whereby the liquid is distributed substantially uniformly and the quantity of liquid applied can be controlled. The invention makes use of the finding that when a yarn laden with a liquid and travelling at high speed changes its direction of travel abruptly, the entrained liquid tends to be expelled from the yarn rather than adopt the new direction of travel.

In one aspect, the invention accordingly provides a method of applying liquid to a yarn comprising applying liquid to excess to the travelling yarn and then causing the yarn to change its direction of travel while excess liquid is separated from the yarn, characterized in that the change in the yarn's direction of travel is abrupt to an extent effective to cause the said excess liquid to be ejected into a space adjacent the yarn by failing to wholly make said change in direction of travel with the yarn and in that the liquid so ejected is collected from the said atmosphere.

The invention further provides a liquid applicator apparatus comprising means to apply liquid to excess to a travelling yarn and guide means to cause the yarn to change its direction of travel while excess liquid is separated from the yarn, characterized in that said guide means is arranged to cause said yarn to change its direction of travel abruptly to an extent effective to cause said excess liquid to be ejected into a space adjacent the yarn by failing to wholly make said change in direction of travel with the yarn and in that means is provided to collect further surrounding atmosphere liquid so ejected from the yarn.

Without in any way limiting the scope of the invention, a preferred embodiment will now be described with reference to the accompanying drawings, in which.

Figure 1:
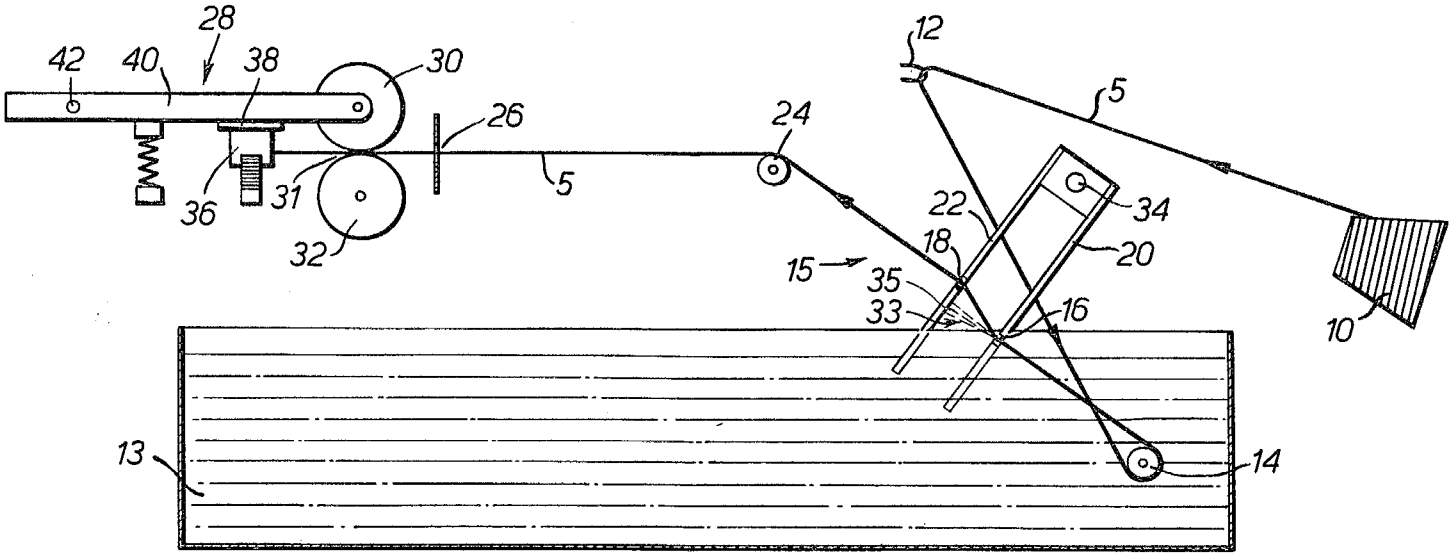
FIG. 1 is a schematic side-elevational view of equipment arranged for applying liquid to yarn in accordance with the invention.
Figure 2:
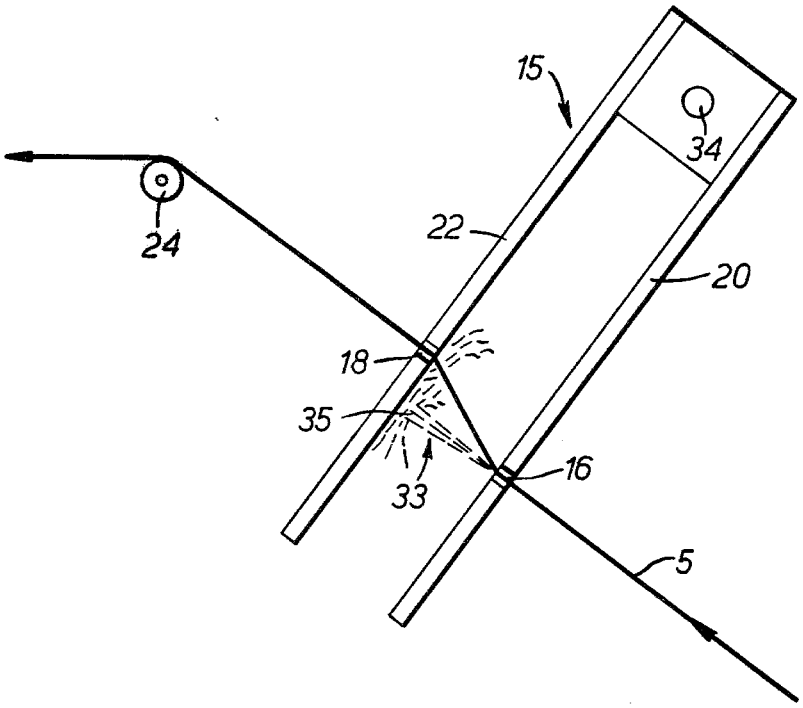
FIG. 2 is a schematic enlargement of part of FIG. 1, illustrating in greater detail the principles of the invention.
Figure 3:
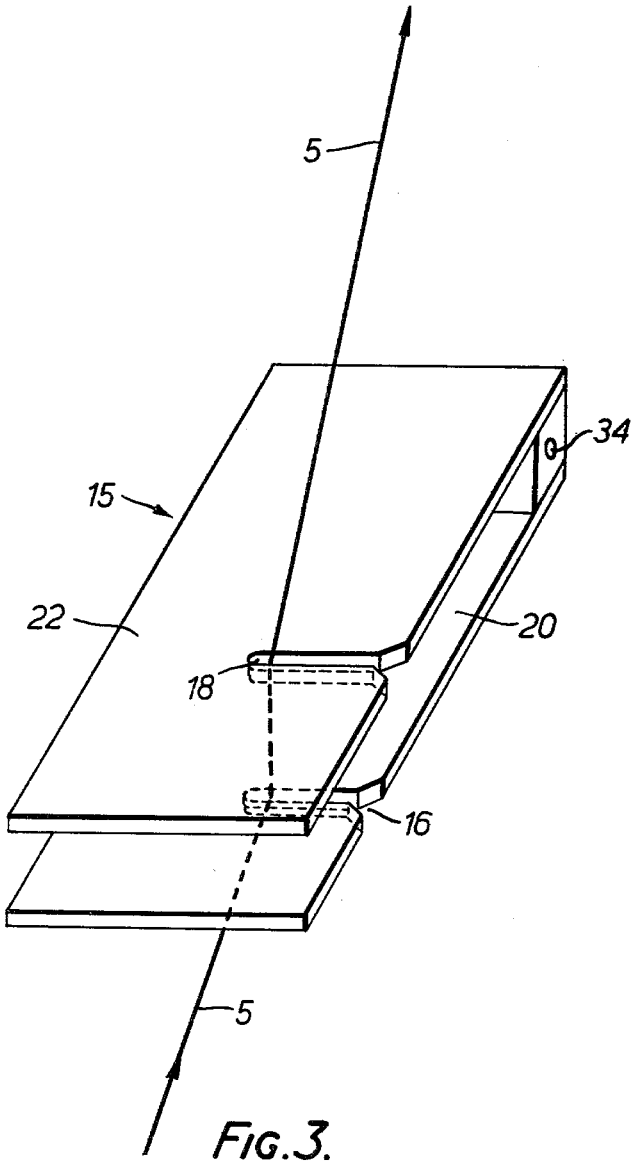
FIG. 3 is a perspective view of the guide assembly forming part of the equipment shown in FIGS. 1 and 2.

With reference to FIG. 1, travelling yarn 5 is unwound from a cone 10, passed about an eye guide 12 and thence round a disc or pulley guide 14 submerged in a bath of dye liquor 13. Pulley guide 14 substantially reverses the direction of travel of the yarn. On emerging from the bath, the yarn is led in turn through slots 16 and 18 in respective plates 20 and 22 together comprising a guide assembly 15, and thence via guides 24 and 26 to drive means 28 including driven roller 30 and idler or follower roller 32.

Plates 20, 22 lie parallel and closely spaced, and are mounted at pivot 34 for rotation as an assembly to vary the angle of incidence of the yarn to each plate. Slots 16, 18 are offset so as to cause the yarn to abruptly change its direction of travel at each plate as it contacts an edge at each slot.

The change of direction of travel on the part of the yarn in passing through slot 16 is made abrupt to an extent effective to cause the excess liquid to be ejected into a space 33 adjacent the yarn by failing to wholly make the change in direction of travel with the yarn. In such circumstance, the liquor has an overall tendency to continue in the direction of the line from guide 14 to slot 16. A proportion of the liquor is ejected from the yarn onto plate 22 in a continuous stream 35. Plate 22 thus collects the liquor so ejected and returns it into the bath. The quantity of liquor remaining on the wet yarn is related to the angular change in direction of the yarn, and may therefore be controlled by varying the angle, such as by moving guide assembly 15 about pivot 34. The yarn changes direction again at slot 18 in plate 22. This may result in loss of a further, smaller volume of liquor, which is collected by the upper surface of plate 22 and directed to the bath. In addition to losing excess liquor, the wetted yarn is compressed as it contacts the edge of each slot, and even distribution of liquor throughout the yarn is thereby encouraged.

The actual extent to which liquor is lost from the yarn at guide assembly 15 is set according to the required final pick-up of liquor—ratio by weight of liquor to yarn—and taking due account of factors such as yarn composition, diameter, tension and absorbency, and liquor viscosity, all of which can be expected to be influential. With adjustable mechanism such as that illustrated it is a simple matter for an operator to determine the optimum setting to meet prevailing conditions and requirements. It is found that for yarn velocities of the order of or greater than 100 meters/minute, a change of direction of at least 20° is required before there is any significant loss of liquor from a yarn.

In FIG. 1, it will be noticed that the various guides are so positioned that the yarn 5 undergoes substantially a complete reversal of direction during its travel through the bath. It is preferred practice that the yarn should undergo a direction change of at least 150° and preferably more than 180°, within the bath, so that the entry and exit points of the yarn at the bath surface are fairly close. Yarn returning to the liquor surface thereby creates a liquor flow to counteract the "pumping" away of liquor by yarn entering the bath.

To realize maximum benefits from the liquor extraction guide assembly it is advisable that the yarn propulsion system is not itself the cause of any significant liquor loss. To this end, in drive means 28, the driven upper roller 30 does not come into contact with lower idler roller 32, but is positioned so that the gap 31 between the rollers is sufficient to grip the wetted yarn without expelling further liquor by squeezing. Roller 30 is slightly moveable to vary the gap by adjustment of a calibrated nut 36. Nut 36 determines the vertical position of a stop plate 38 acting against a downwardly biased spring loaded bearing arm 40 which carries roller 30 at one end and is rotatable about a pivot 42 at the other. The device is readily calibrated to suit various yarn types and diameters.

With the method described herein, it is possible to apply and control liquid pick-up from 50–100% on yarn travelling at speeds of 100 meters/min. and greater. Apparatus such as that depicted in FIG. 1 can readily be incorporated in a continuous or semi-continuous yarn treatment range, and is particularly useful in the controlled application of dye to textile yarns, where the subsequent step is usually continuous steaming and/or drying.

It will be apparent to those skilled in the art that the dual slotted plate assembly described herein represents only one of many equivalent ways of achieving the objects of the invention. Two changes of direction are not essential and any edge effective to produce the required abrupt change of direction of travel will meet the requirements of the invention. It is found that the edge should preferably have a radius of curvature no more than about 0.5 mm. The slotted plate system depicted in the drawings has the merit of simple, robust construction and affords an effective arrangement for collecting and recycling liquor ejected from the yarn. Other, systems might make use of, for example, fixed or rotating pins, or the boundary edges of unslotted plates to cause yarn direction change. Alternatively, a greater number of slotted plates may be employed, or the plates may be capable of individual adjustment. This may be achieved by slideably mounting the plates to the same pivot, by mounting them to separate pivots or by a combination of such mechanisms, thus allowing a substantial degree of independent control over liquor loss at each slot.

EXAMPLE 1

A spun yarn of wool (diameter 1.2 mm, wt/m 0.13 gm) was passed at 600 meters/minute through an applicator as described above and illustrated herein. The bath contained liquor comprising 3 parts by weight of C.I. Reactive Red 99, 2 parts wetting agent (levalin VKU—Bayer), 10 parts lactic acid, 5 parts urea and 80 parts water. The slotted plates were positioned so that the yarn was diverted through 20° at slot 16 and 20° at slot 18, giving a pick up of 100%. The impregnated yarn was fed on to a conveyor and steamed at 100° for 7 minutes. After washing off and drying the yarn was found to be uniformly dyed and had similar fastness properties to wool yarn dyed by conventional methods.

EXAMPLE 2

A spun yarn of wool having a linear density of 141 g/kilometer was passed at 520 m/min. through a liquid applicator as illustrated herein. The bath contained a liquor comprising 0.75 parts of wetting agent (Levalin VKU—Bayer) and 99.25 parts of water. After immersion in the bath the wet yarn was deflected by the angle $\theta$ at slot 16 and by the angle $\Phi$ at slot 18. The quantity of liquor retained by the yarn (pick-up) for various settings of guide assembly 15, and consequently for various inter-related angles of deflection $\theta$ and $\Phi$, is tabulated below as a percentage of the dry weight of yarn.

| $\theta$ | $\phi$ | Pick-up (%) |
|---|---|---|
| 26°30′ | 31° | 104 |
| 40°30′ | 41°25′ | 90 |
| 50°25′ | 51°5′ | 84 |
| 62°20′ | 62°45′ | 80 |
| 72°15′ | 75° | 71 |
| 84°20′ | 93° | 64 |

EXAMPLE 3

Example 2 was repeated, but with a spun yarn of wool having a linear density of 101 g/kilometer. Smaller angles $\theta$, $\Phi$ were also investigated. The resultant pick-up for various angles of deflection is listed below.

| $\theta$ | $\phi$ | Pick-up (%) |
|---|---|---|
| 0 | 0 | 126 |
| 7° | 12° | 126 |
| 15° | 21° | 125 |
| 26°30′ | 31° | 111 |
| 40°30′ | 41°25′ | 102 |
| 50°25′ | 51°5′ | 89 |
| 62°25′ | 62°45′ | 78 |
| 72°15′ | 75° | 71 |
| 84°20′ | 93° | 62 |

It will be noted that, in this particular case, liquor loss of deflection is negligible for the $\theta=7°$ and $\theta=15°$ settings.

I claim:

1. An apparatus for controlling liquid application to a yarn comprising applicator means for applying liquid in excess to a yarn including a receptacle for holding a supply of liquid and guide means for guiding a yarn through a liquid in said receptacle and means for removing excess liquid from said yarn including a pair of flat parallel spaced apart plates secured together, pivot means adjustably supporting said plates, as an assembly above said receptacle at selected angles relative to the surface of a liquid in said receptacle, a yarn guide edge on each plate with one of said guide edges being offset from the other of said guide edges so that the path of travel of said yarn as it is guided from a liquid in said receptacle by said guide means changes direction as the yarn passes from said one of said guide edges to the other of said guide edges and a portion of the plate having said other of said guide edges overlying said one of said guide edges to catch the liquid thrown from the yarn as it changes direction and to guide said liquid back to said receptacle.

2. An apparatus as set forth in claim 1, wherein each of said yarn guide edges is defined by a slot in each plate extending inwardly from one edge thereof parallel to the axis of said pivot means.

* * * * *